US008662034B2

(12) United States Patent
Cuniberti et al.

(10) Patent No.: US 8,662,034 B2
(45) Date of Patent: Mar. 4, 2014

(54) MULTI-CYLINDER INTERNAL COMBUSTION ENGINE WITH A SYSTEM FOR VARIABLE ACTUATION OF THE INTAKE VALVES SUBDIVIDED INTO SEPARATE SUB-UNITS

(75) Inventors: Marco Cuniberti, Orbassano (IT); Luca Iannarelli, Orbassano (IT); Gianluca Canino, Orbassano (IT); Rosario Nasto, Orbassano (IT)

(73) Assignee: C.R.F. Societá Consortile per Azioni, Orbassano (Torino) (IT)

( * ) Notice: Subject to any disclaimer, the term of this patent is extended or adjusted under 35 U.S.C. 154(b) by 216 days.

(21) Appl. No.: 13/281,771

(22) Filed: Oct. 26, 2011

(65) Prior Publication Data

US 2013/0032106 A1 Feb. 7, 2013

(30) Foreign Application Priority Data

Aug. 1, 2011 (EP) ..... 11176174

(51) Int. Cl.
*F01L 9/02* (2006.01)

(52) U.S. Cl.
USPC ..... 123/90.12; 123/90.48

(58) Field of Classification Search
USPC ..... 123/90.16, 90.48, 90.12
See application file for complete search history.

(56) References Cited

U.S. PATENT DOCUMENTS

| | | | | |
|---|---|---|---|---|
| 5,127,375 | A | 7/1992 | Bowman et al. | |
| 6,769,409 | B2 * | 8/2004 | Evancik et al. | 123/470 |
| 2009/0000580 | A1 | 1/2009 | Proschko | |
| 2010/0326384 | A1 | 12/2010 | Vattaneo | |

FOREIGN PATENT DOCUMENTS

| | | |
|---|---|---|
| EP | 0803642 | 11/2000 |
| EP | 1 338 764 A1 | 8/2003 |
| EP | 1338764 | 8/2003 |
| EP | 1726790 | 11/2006 |
| JP | 6147053 A | 5/1994 |

OTHER PUBLICATIONS

European Patent Office Action dated Feb. 27, 2013, from European Patent Application No. EP 11176174.8.

* cited by examiner

*Primary Examiner* — Zelalem Eshete
(74) *Attorney, Agent, or Firm* — Nixon & Vanderhye P.C.

(57) ABSTRACT

An engine comprises a system for variable actuation of the intake valves and is subdivided into a plurality of sub-systems independent with respect to each other, carried by a plurality of respective elements, each mounted on the cylinder head at a respective engine cylinder. Among other things, this considerably facilitates the system maintenance operations.

5 Claims, 14 Drawing Sheets

MULTI-CYLINDER INTERNAL COMBUSTION ENGINE WITH A SYSTEM FOR VARIABLE ACTUATION OF THE INTAKE VALVES SUBDIVIDED INTO SEPARATE SUB-UNITS

The present invention refers to internal combustion engines of the type provided with a system for variable actuation of the intake valves of the engine.

Even more particularly, the invention refers to multi-cylinder internal combustion engines which comprise, for each cylinder:

- at least one intake valve and at least one exhaust valve each provided with respective return spring means which push the valve towards a closed position, for controlling respective intake and exhaust conduits,
- at least one camshaft, for actuating the intake valves of the engine cylinders by means of respective tappets,
- wherein each intake valve is controlled by the respective tappet, against the action of the aforementioned return spring means, by interposing hydraulic means including a pressurised fluid chamber and a hydraulic actuator associated to each intake valve and connected to said pressurised fluid chamber,
- said pressurised fluid chamber being adapted to be connected by means of a solenoid valve with an exhaust channel with the aim of decoupling the intake valve from the respective tappet and causing the quick closure of the valve due to the respective return spring means,
- said hydraulic actuator further being provided with hydraulic braking means for slowing the final phase of the travel for closing the intake valve controlled thereby when the pressure chamber is connected to the exhaust channel,
- electronic control means for controlling each solenoid valve so as to vary the opening and/or closing and/or lift instants of the respective intake valve as a function of one or more engine operative parameters,
- wherein the hydraulic means for controlling the intake valves of the engine and the solenoid valves associated thereto are part of a preassembled unit mounted on the engine cylinder head.

An engine of the type indicated above is for example described and illustrated in EP 1 338 764 A1 of the applicant.

Over the years, the Applicant has developed internal combustion engines comprising a system for variable actuation of the intake valves of the type indicated above, sold under the trademark "MULTIAIR". The Applicant owns various patents and patent applications regarding engines provided with a system of the type described above.

According to what is indicated in the document EP 1 338 764 A1 the entire unit for the variable actuation of the intake valves of the engine is integrated in a single "brick" which can be easily also adapted on an engine initially designed without the system for variable actuation of the intake valves.

SUMMARY OF THE INVENTION

The object of the present invention is that of improving the abovementioned known system, particularly making system maintenance operations easier and less expensive.

A further object of the invention is that of achieving the abovementioned objective by means of a relatively simple and reliable structure.

With the aim of attaining such objects, the invention has the object of providing an engine having the characteristics indicated above and further characterised in that the abovementioned preassembled unit is formed by a plurality of separate sub-units, respectively associated to the various engine cylinders and each having an independent support body, mounted on the cylinder head and carrying the hydraulic means and at least one solenoid valve for controlling the intake valves of the respective cylinder.

Therefore, in the engine according to the invention the system for variable actuation of the intake valves is subdivided into a plurality of sub-systems independent with respect to each other, carried by a plurality of respective "bricks", each mounted on the cylinder head at a respective engine cylinder. This considerably facilitates the system maintenance operations, for example in case of failure of a single solenoid valve, in that it is sufficient to demount the single brick carrying said solenoid valve. Preferably, each solenoid valve simply rests within a seat arranged in the respective brick and it is locked therein by means of an auxiliary locking plate which is fastened to the brick.

BRIEF DESCRIPTION OF THE DRAWINGS

Further characteristics and advantages of the invention will be apparent from the description which follows with reference to the attached drawings, provided by way of non-limiting example, wherein.

DETAILED DESCRIPTION OF THE INVENTION

Over the years, the applicant has developed internal combustion engines, petrol or diesel-fuelled, comprising a system for variable actuation of the intake valves of the engine, sold under the trademark "MULTIAIR". The Applicant owns various patents and patent applications regarding engines provided with a system of the type described above.

Figure 1:
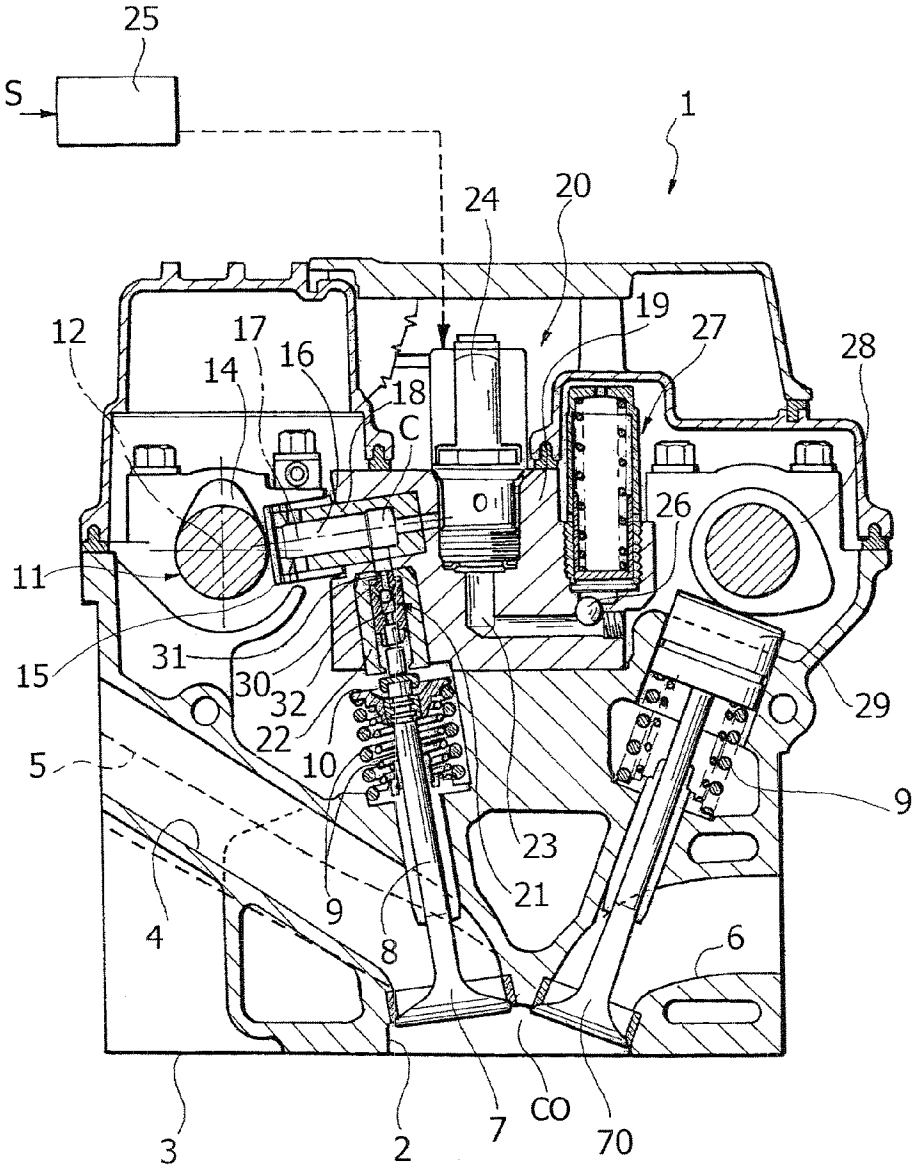
FIG. 1 is a sectional view of an engine according to the known art, of the type described for example in document EP A 0 803 642 of the applicant.

FIG. 1 of the attached drawings shows a sectional view of a petrol-fuelled engine provided with "MULTIAIR" system, as described in the European patent EP 0 803 642 B1 of the applicant.

With reference to FIG. 1, the engine illustrated therein is multi-cylinder engine, for example an engine with four in-line cylinders, comprising a cylinder head 1. The head 1 comprises, for each cylinder, a cavity 2 formed by the base surface 3 of the head 1, defining the combustion chamber, in which the two intake conduits 4, 5 and two exhaust conduits 6 end up. The communication of the two intake conduits 4, 5 with the combustion chamber 2 is controlled by two intake valves 7, of the conventional mushroom type, each comprising a stem 8 slidably mounted in the body of the head 1.

Each valve 7 is returned towards the closed position by springs 9 interposed between an inner surface of the head 1 and an end retaining cap 10 of the valve. The communication of the two exhaust conduits 6 with the combustion chamber is controlled by two valves 70, also of the conventional type, to which springs 9 for return towards the closed position are associated.

The opening of each intake valve 7 is controlled, as described hereinafter, by a camshaft 11 mounted rotatably around an axis 12 within supports of the head 1, and comprising a plurality of cams 14 for actuating the intake valves 7.

Each cam 14 which controls an intake valve 7 cooperates with the plate 15 of a tappet 16 slidably mounted along an axis 17 which, in the case of the example illustrated in the mentioned prior art document, is substantially directed at 90° with respect to the axis of the valve 7. The plate 15 is returned against the cam 14 by a spring associated thereto. The tappet 16 constitutes a pumping piston slidably mounted within a bushing 18 carried by a body 19, or "brick" of a preassembled unit 20, incorporating all electrical and hydraulic devices associated to the actuation of the intake valves, according to the description outlined hereinafter.

The pumping piston 16 is capable of transmitting a thrust to the stem 8 of the valve 7, so as to cause the opening of the latter against the action of the elastic means 9, by means of pressurized fluid (preferably oil coming from the engine lubrication circuit) present in a pressure chamber C to which the pumping piston 16 is faced, and by means of a piston 21 slidably mounted in a cylindrical body constituted by a bushing 22 also carried by the body 19 of the sub-unit 20.

Still in the known solution described in FIG. 1, the pressurised fluid chamber C associated to each intake valve 7 can be placed in communication with an exhaust channel 23 through a solenoid valve 24. The solenoid valve 24, which can be of any known type adapted to the function illustrated herein, is controlled by electronic control means, indicated schematically with 25, as a function of the signal S indicating the operating parameters of the engine, such as the position of the accelerator and the number of engine revolutions.

When the solenoid valve 24 is open, the chamber C enters in communication with the channel 23, hence the pressurised fluid present in the chamber C flows into such channel and thus obtaining the decoupling of the cam 14 and the decoupling of the respective tappet 16 from the intake valve 7, which thus quickly returns to the closing position thereof under the action of the return springs 9. Thus, controlling the communication between the chamber C and the exhaust channel 23, allows varying the opening time and the travel of each intake valve 7 at will.

The exhaust channels 23 of the various solenoid valves 24 end up in the same longitudinal channel 26 communicating with pressure accumulators 27, only one of which can be observed in FIG. 1.

All tappets 16 with the associated bushings 18, the pistons 21 with the associated bushings 22, the solenoid valves 24 and the respective channels 23, 26 are carried by and obtained from the abovementioned body 19 of the preassembled unit 20, to the advantage of an engine that is quick and easy to assemble.

The exhaust valves 70 associated to each cylinder are controlled, in the embodiment illustrated in FIG. 1, conventionally, by a respective camshaft 28, through respective tappets 29, even though, in the case of the mentioned prior art document, an application of the hydraulic actuation system also controlling exhaust valves cannot be excluded generally.

Still with reference to FIG. 1, the variable volume chamber defined within the bushing 22 and facing the piston 21 (which is illustrated in the minimum volume condition thereof in FIG. 1, piston 21 being in the upper end stop position thereof) communicates with the pressurised fluid chamber C through an opening 30 obtained in an end wall of the bushing 22. Such opening 30 is engaged by an end nose 31 of the piston 21 so as to provide a hydraulic braking of the movement of the valve 7 in the closing phase, when the valve is close to the closing position, in that the oil present in the variable volume chamber is forced to flow into the pressurised fluid chamber C passing through the clearance present between the end nose 31 and the opening wall 30 engaged thereby. Besides the communication constituted by the opening 30, the pressurised fluid chamber C and the variable volume chamber of the piston 21 communicate with respect to each other through internal passages obtained in the body of the piston 21 and controlled by a check valve 32 which allows the passage of fluid only from the pressurized chamber C to the variable volume chamber of the piston 21.

During the normal operation of the known engine illustrated in FIG. 1, when the solenoid valve 24 excludes the communication of the pressurised fluid chamber C with the exhaust channel 23, the oil present in such chamber transmits the movement of the pumping piston 16, imparted by the cam 14, to the piston 21 which controls the opening of the valve 7. In the initial phase of the opening movement of the valve, the fluid coming from the chamber C reaches the variable volume chamber of the piston 21 passing through the check valve 32 and further passages which place the internal cavity of the piston 21, which is tubular-shaped, in communication with the variable volume chamber. After a first displacement of the piston 21, the nose 31 exits from the opening 30, hence the fluid coming from the chamber C may pass directly into the variable volume chamber through the opening 30, now free.

In the reverse movement for closing the valve, as previously mentioned, during the final phase, the nose 31 enters into the opening 30 causing the hydraulic braking of the valve, so as to avoid impacts of the body of the valve against the seat thereof, for example after an opening of the solenoid valve 24 which causes the immediate return of the valve 7 to the closed position.

In the described system, when the solenoid valve 24 is enabled, the valve of the engine follows the movement of the cam (full lift). An early closing of the valve can be obtained by disabling (opening) the solenoid valve 24, thus emptying the hydraulic chamber and obtain the closing of the valve of the engine under the action of the respective return springs. Analogously, a delayed opening of the valve can be obtained by delaying the opening of the solenoid valve, while the combination of a delayed opening with an early opening of the valve can be obtained by enabling and disabling the solenoid valve during the thrust of the relative cam. According to an alternative strategy, in compliance with the teachings of the patent application EP 1 726 790 A1 of the applicant, each intake valve can be controlled in "multi-lift" mode i.e. according to two or more repeated opening and closing "sub-cycles". In each sub-cycle, the intake valve opens and then closes completely. The electronic control unit is thus capable of obtaining a variation of the opening instant and/or the closing instant and/or the lift instant of the intake valve, as a function of one or more engine operative parameters. This allows obtaining the maximum efficiency of the engine, and lower consumption of fuel, under any condition of operation.

In FIGS. 2-12, the common parts or those corresponding to those of FIG. 1 are indicated using the same reference number.

Figure 2:
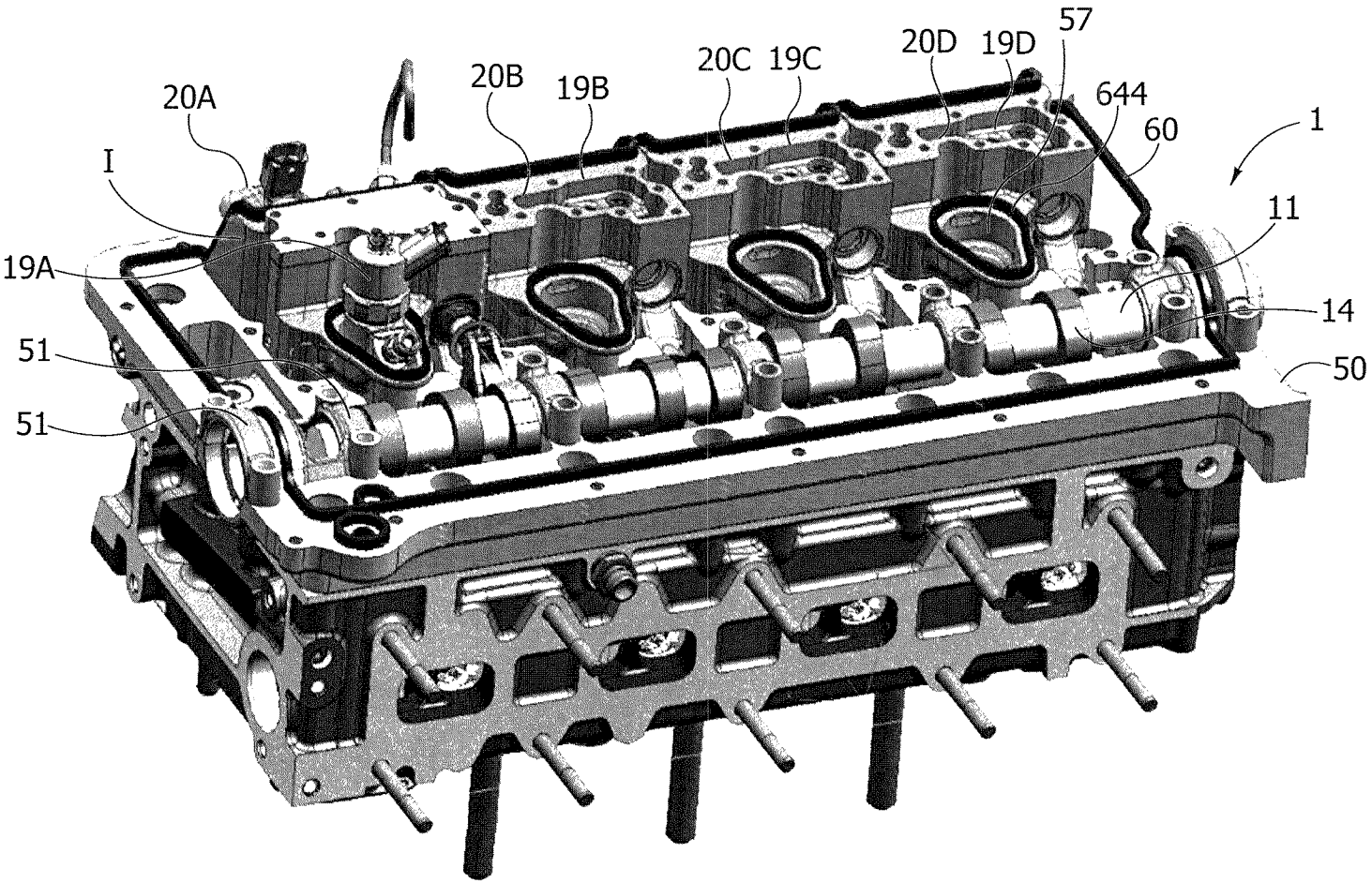
FIG. 2 is a partial perspective view of the cylinder head of a diesel engine according to a first embodiment of the present invention.

With reference to FIG. 2, a body 50 for supporting the camshaft 11—in which the seats for supporting the rotation of the shaft 11, on which the latter is held by means of caps 51 fastened on the body 50—is mounted on the cylinder head 1. The illustrated example refers to the case of a four-cylinder diesel engine. However, the invention is also applicable to a controlled ignition engine and with any number of cylinders.

The main characteristic of the solution illustrated in the FIG. 2 lies in the fact that the pre-assembled unit for the variable actuation of the intake valves of the engine is constituted by four separate sub-units 20A, 20B, 20C, 20D, each comprising a respective support independent body or "brick", respectively indicated with 19A, 19B, 19C, 19D.

Figure 3A:
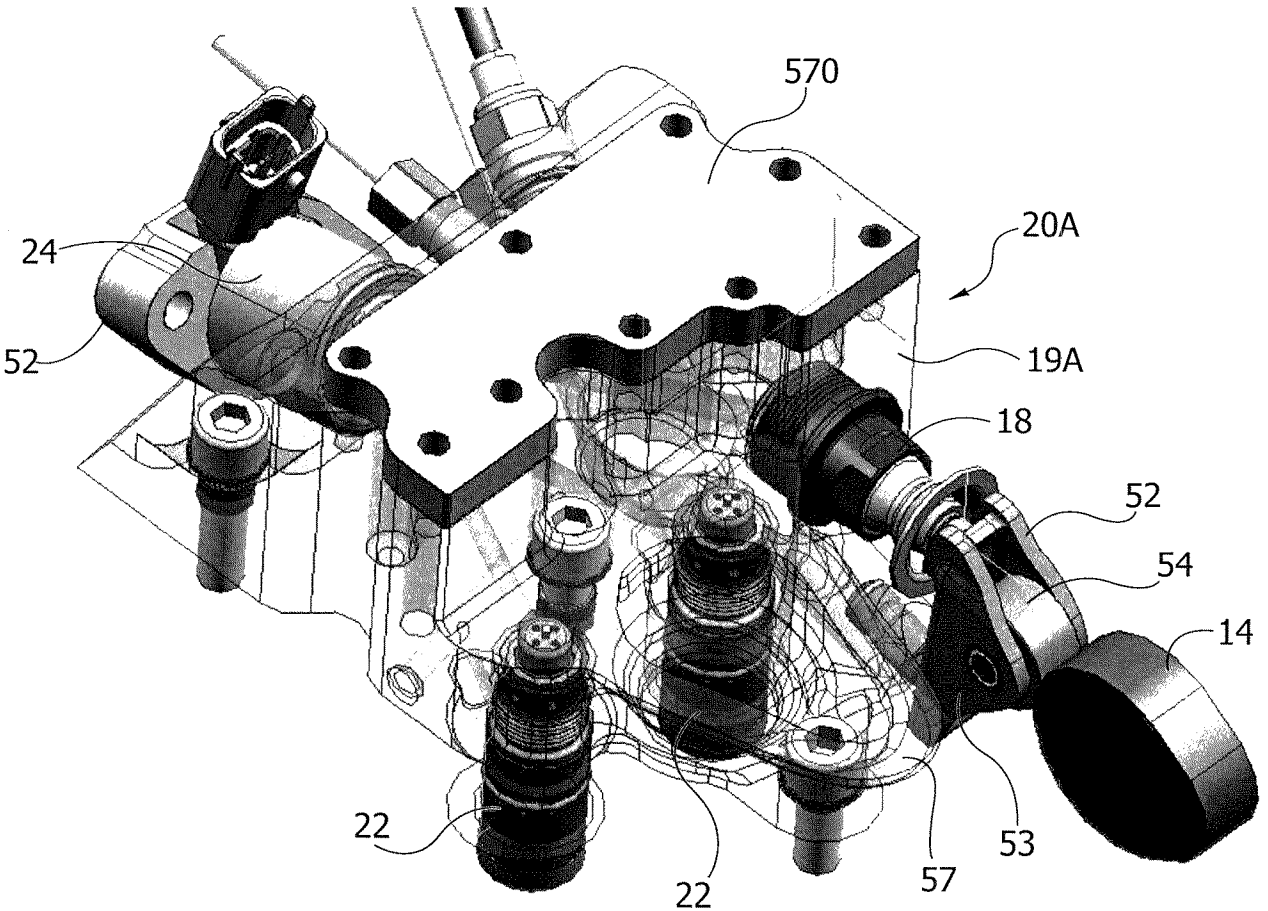
FIG. 3A is a perspective view, partially transparent, of a single sub-unit for the variable actuation of the intake valves associated to an engine cylinder of FIG. 2.
Figure 3B:
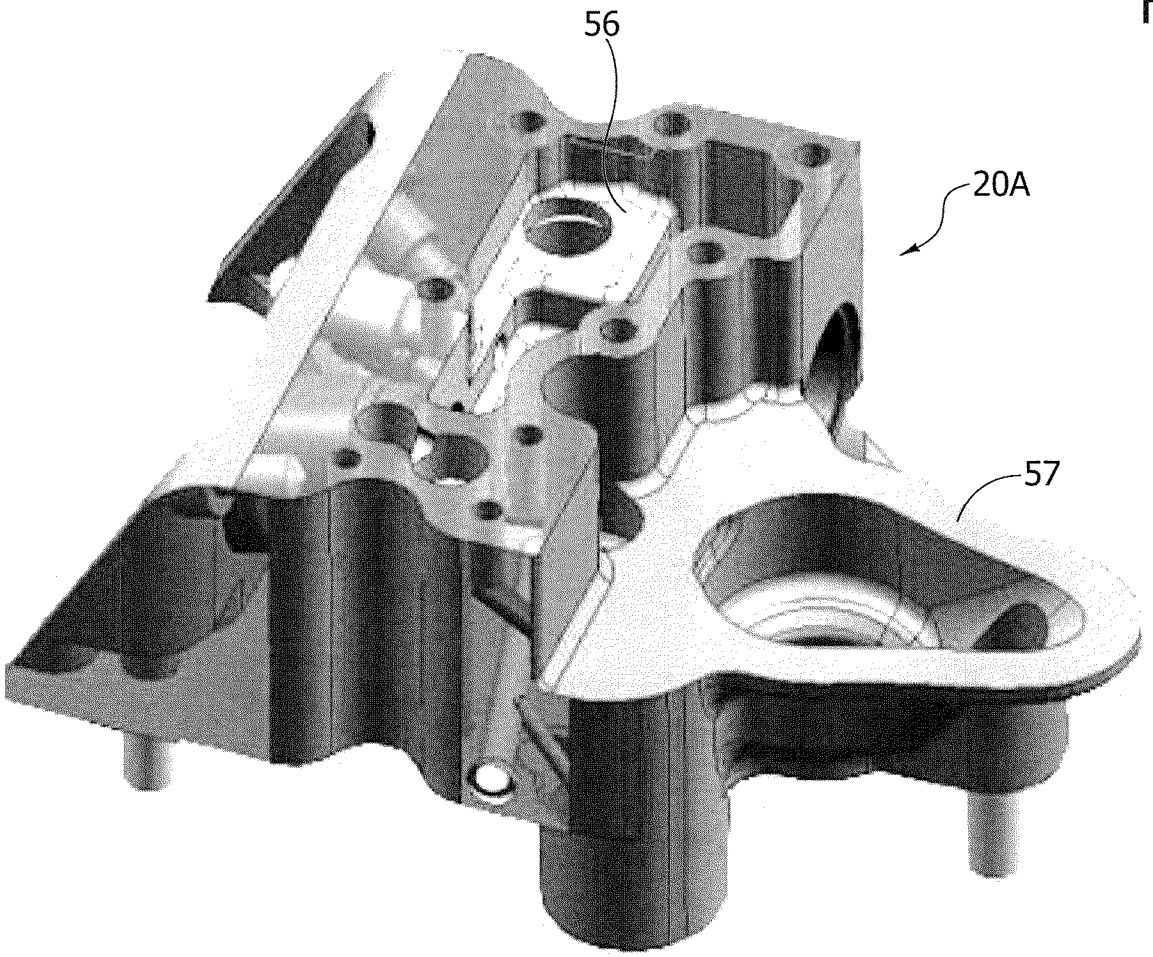
FIG. 3B is a further perspective view of the support body of the sub-unit of FIG. 3A, FIGS. 4, 5 are sectional views showing the detail of a bracket for locking an injector of the engine of FIG. 2.
Figure 4:
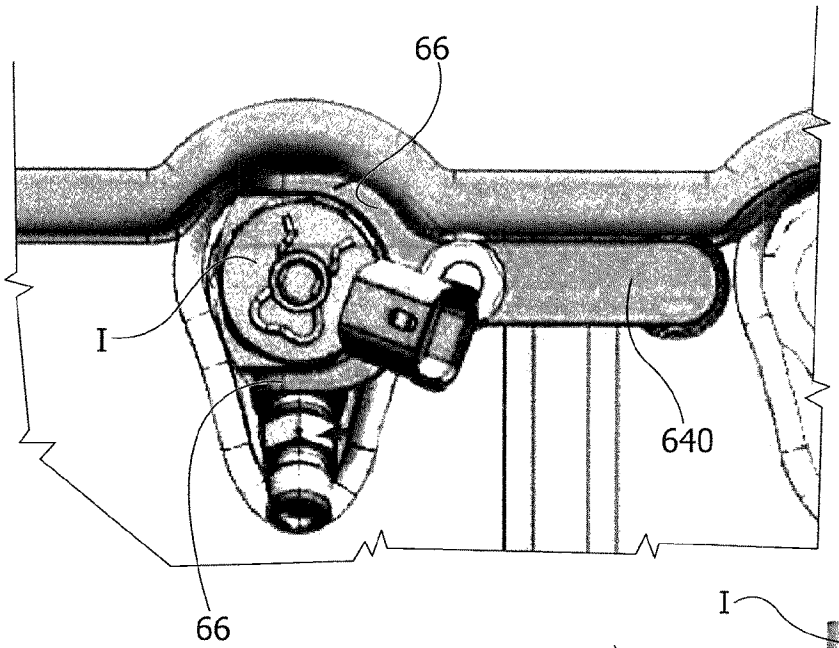
Figure 5:
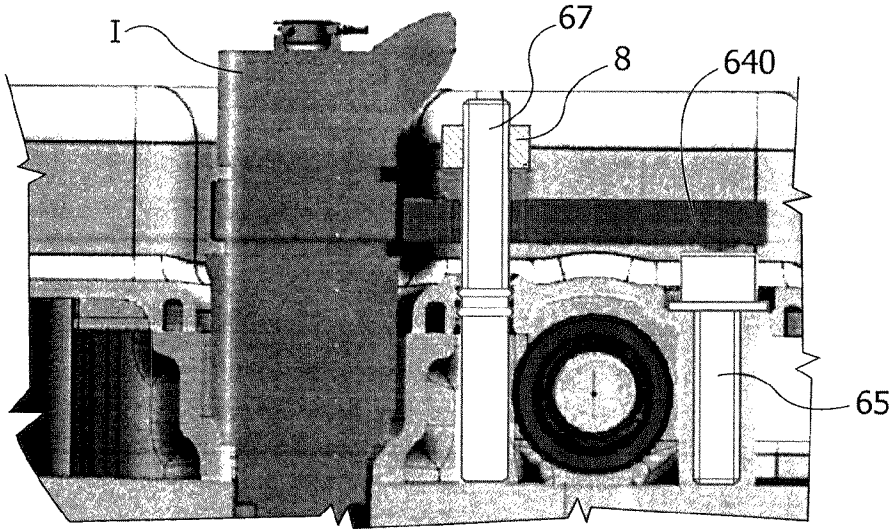
Figure 6:
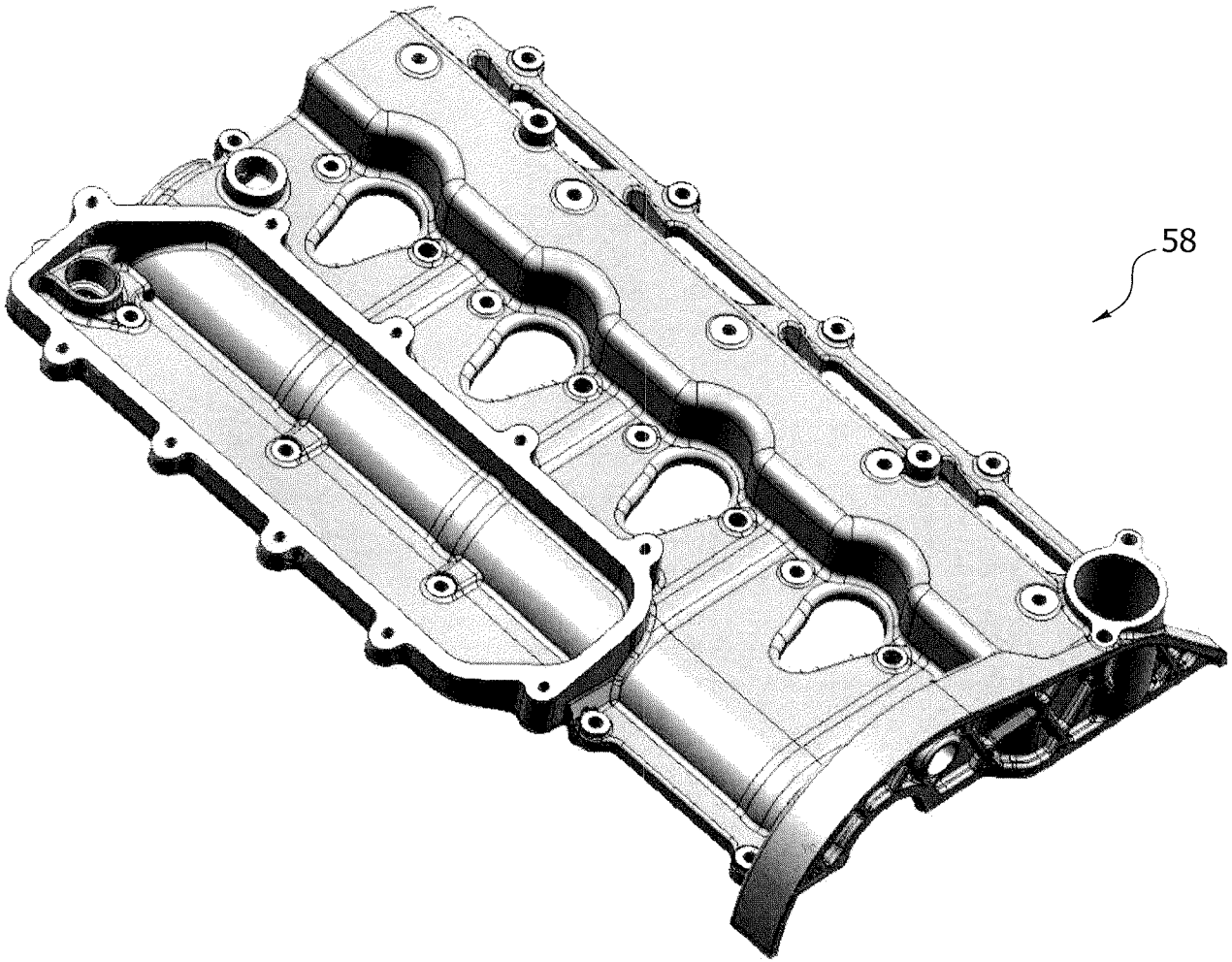
FIG. 6 is a perspective view of a cover associated to the cylinder head of FIG. 2.

As observable in FIG. 3A, the body 19A of the sub-unit 20A, and analogously each of the other bodies 19B, 19C, 19D of the sub-units 20B, 20C, 20D carries all the devices intended to allow actuating the intake valves of the respective engine cylinder. In particular, with reference to the sub-unit 20A, the sub-unit carries the pumping cylinder 18 whose stem is actuated by a respective cam 14 by means of a rocker arm lever 52, articulated in 53 to the support body 19A and carrying a roller 54 for the engagement of the cam 14. Furthermore, the support body 19A of the sub-unit 20A carries the two hydraulic actuators 22 respectively associated to two intake valves of the respective engine cylinder. Furthermore, the body 19A carries the body of the solenoid valve 24, which simply rests within a seat arranged in the body 19A and it is locked by means of a locking plate 52 fixed by means of screws to the body 19A. Obviously all ducts required for the hydraulic connection of the system for variable actuation of the valves are obtained within the body 19A. Lastly, an upper cavity of the body 19A (indicated with 56 in FIG. 3B) is closed by means of a cover 570 fastened on the body 19A.

What is indicated above with reference to the unit 20A obviously also applies for the sub-units 20B, 20C and 20D.

The illustrated example, as mentioned, refers to the case of a diesel engine. FIG. 2 shows one of the injectors associated to the engine cylinders, indicated with the reference I. Each injector I is mounted in the cylinder head through a cup-shaped casing 57, illustrated more in detail hereinafter and which is made in a single piece with the respective support body 19A of the respective sub-unit 20A.

The unit for variable actuation of the intake valves of the engine, constituted by the plurality of sub-units 20A-D is closed at the upper part by a cover 58 with the interposition of a sealing gasket 60.

In the illustrated example, the sealing gasket 60 is received in a corresponding peripheral groove of the cover 58 (see FIG. 7) and respectively provides sealing on the bodies 19A-D and on the body 50 for supporting the camshaft.

However, it should be observed that the architecture of the head described above is provided purely by way of non-limiting example. For example, the body 50 for supporting the camshaft could be made in a single piece with the cylinder head, or it could be made in several pieces respectively integrated in the support bodies of the sub-units 20A-D.

Regardless of the selected architecture, the sealing gasket 60 has a main portion contained in a general base plane of the cover 58, and a plurality of portions 61A-D arranged longitudinally adjacent to each other along one side of the head and associated respectively to the various support bodies 19A-D of the sub-units 20A-D. Each of said portions 61A-D has two lateral portions 62 which extend in planes parallel and orthogonal to the abovementioned general base plane, and a central portion 63 which extends in a parallel plane with respect to the abovementioned general base plane and raised with respect thereto. In particular, as observable in FIG. 7, each of the lateral portions 62 has a rectilinear main section which—at the end—extends in two brief sections one respectively contained in the general base plane of the cover and the other in the plane in which the central portions 63 extend.

Figure 8:
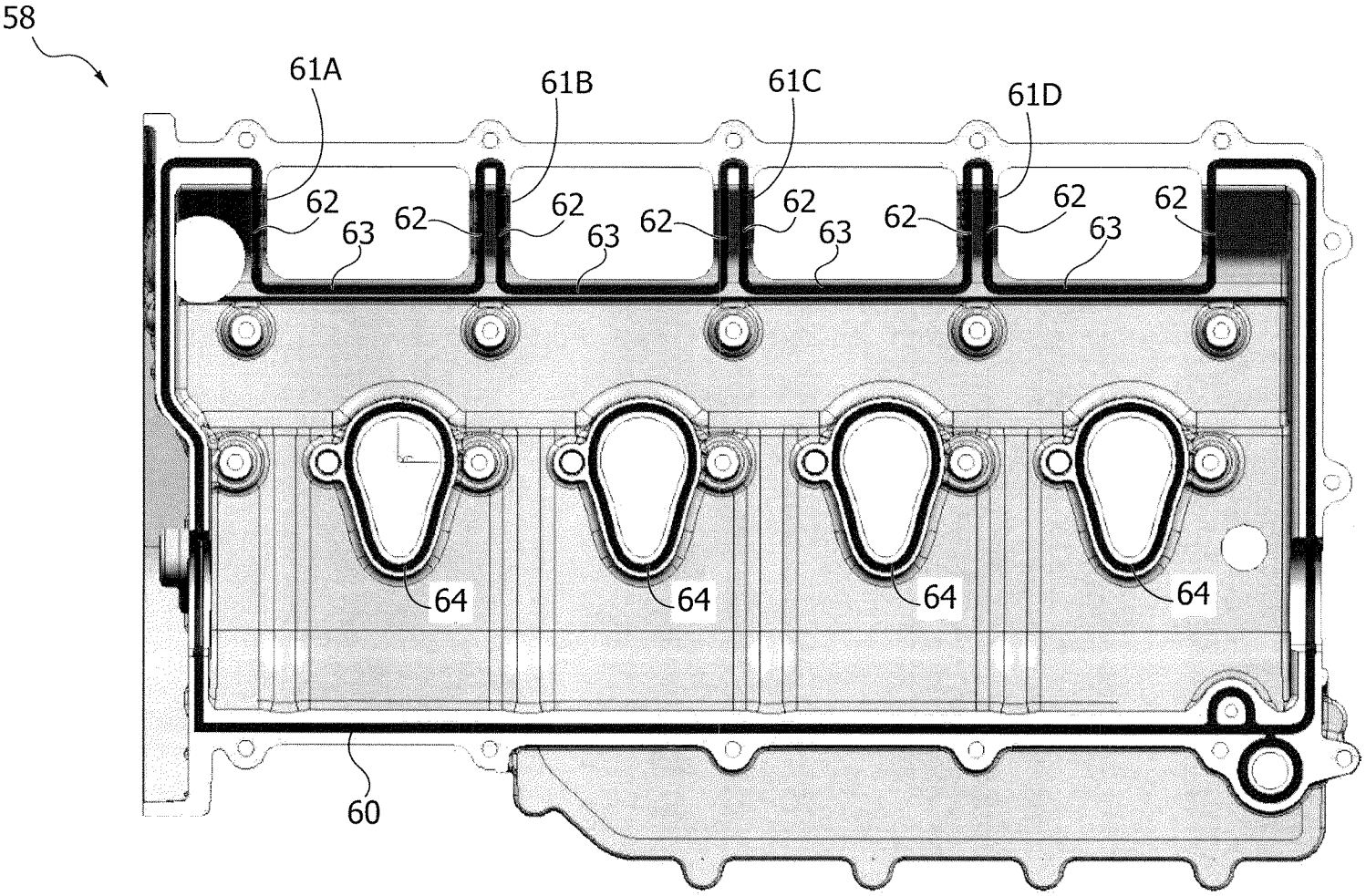
FIG. 8 is a bottom view of the cover of FIG. 6.
Figure 8A:
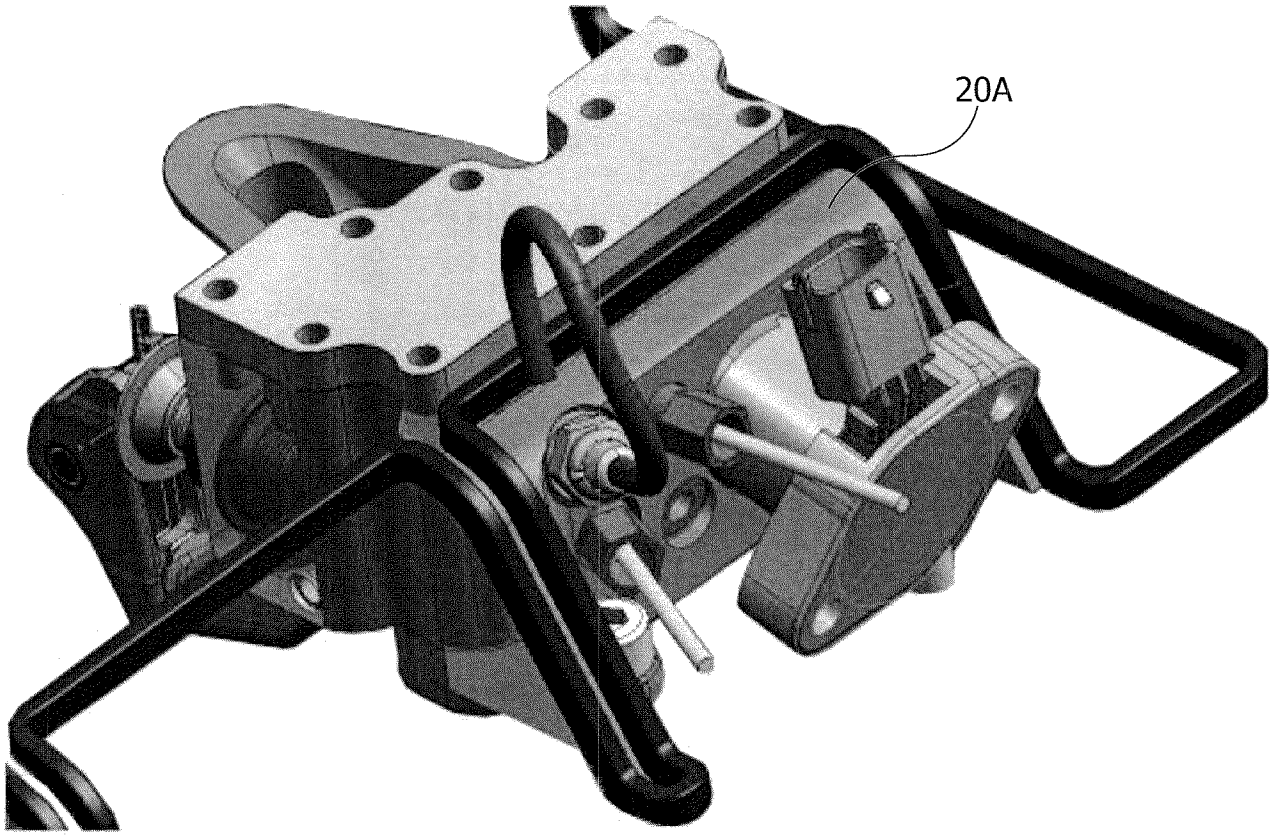
FIG. 8A is still a perspective view of a single sub-unit for actuating the intake valves associated to an engine cylinder.
Figure 8B:
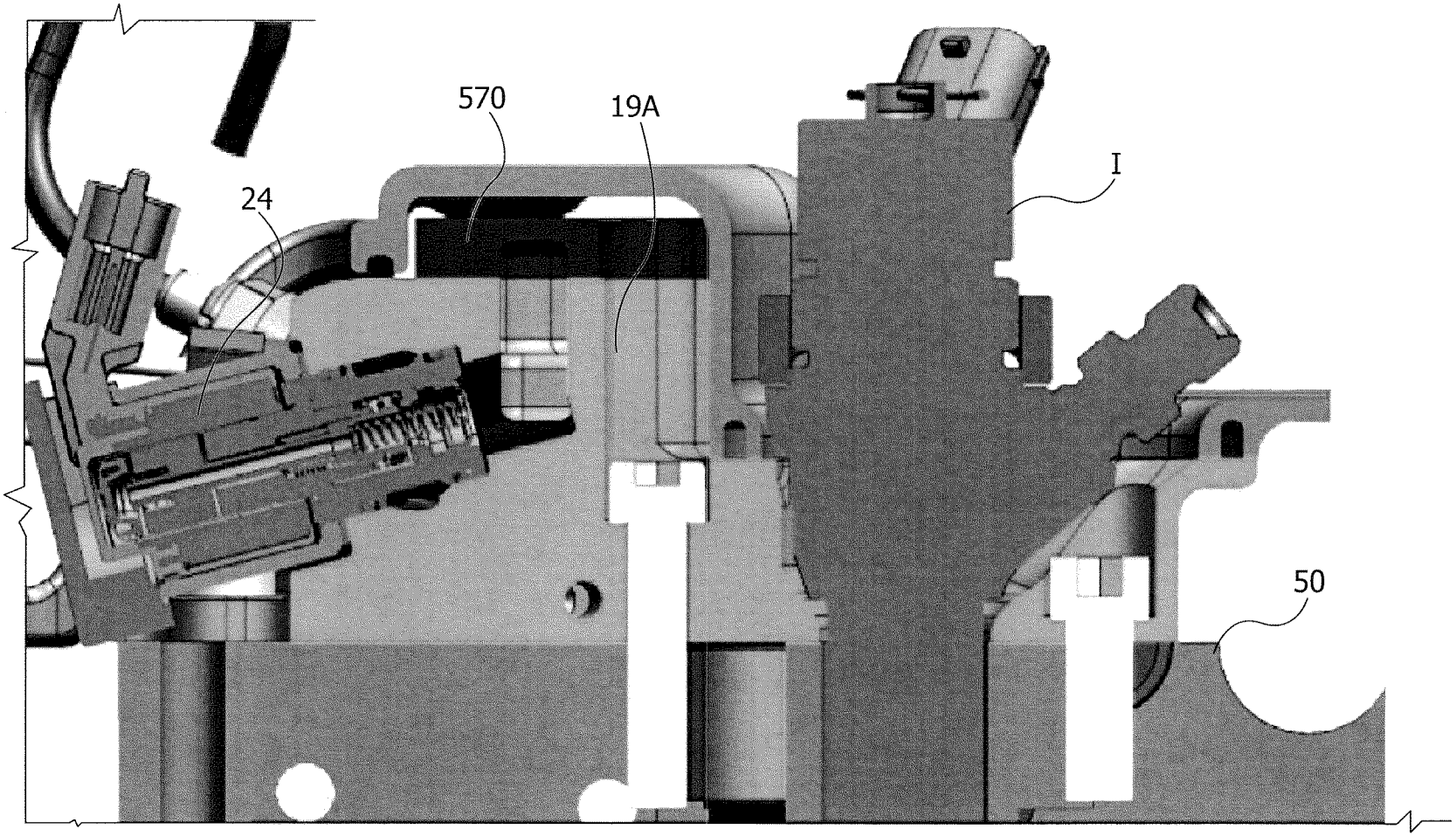
FIG. 8B is a sectional view of the sub-unit of the FIG. 8A.
Figure 9:
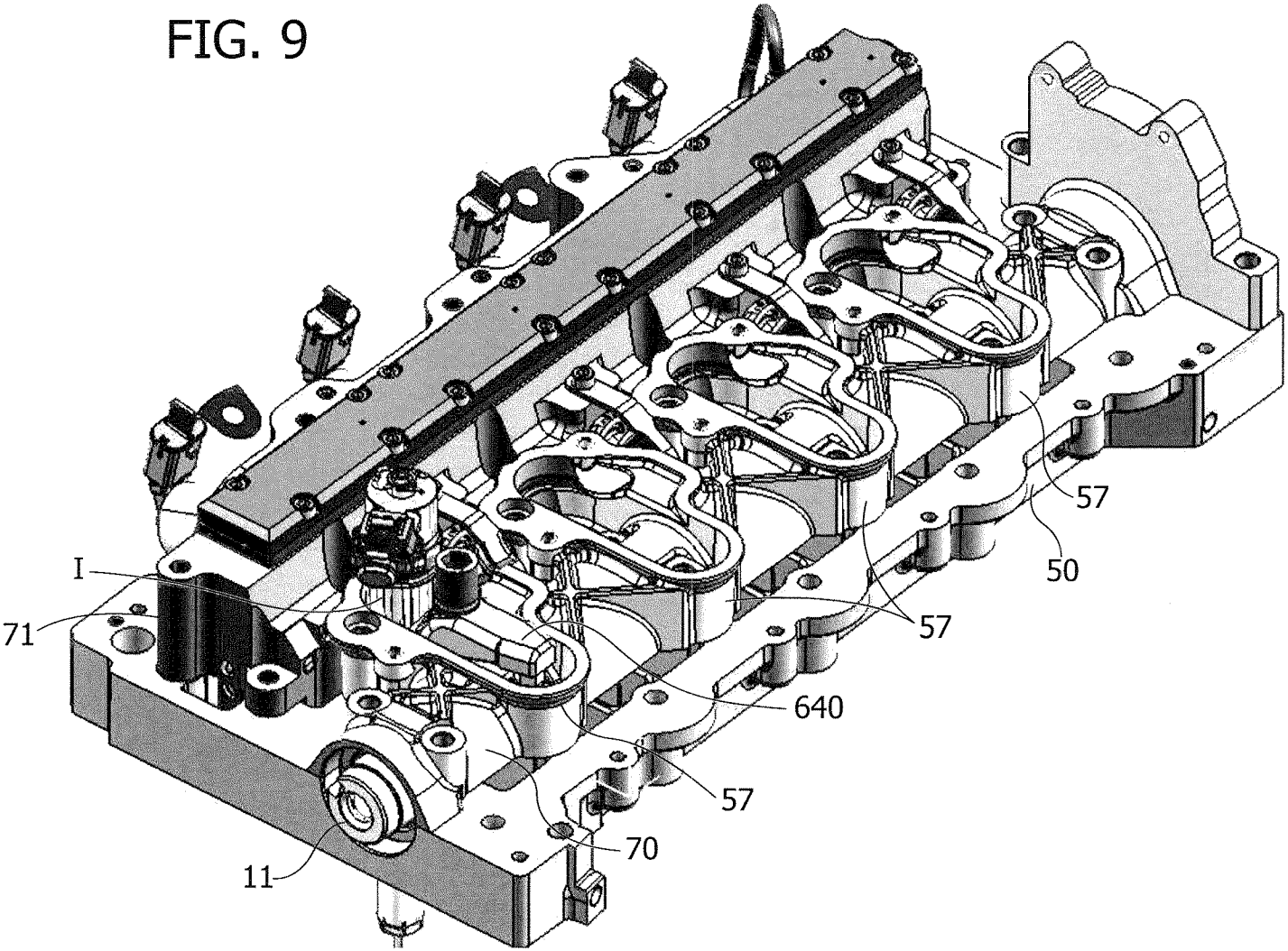
FIG. 9 is a perspective view of a unit associated to the cylinder head of a further embodiment of a diesel engine provided with a system for variable actuation of the intake valves of the engine, which is not part of the present invention, in that it does not include separate sub-units for actuating the intake valves of the different cylinders.
Figure 10:
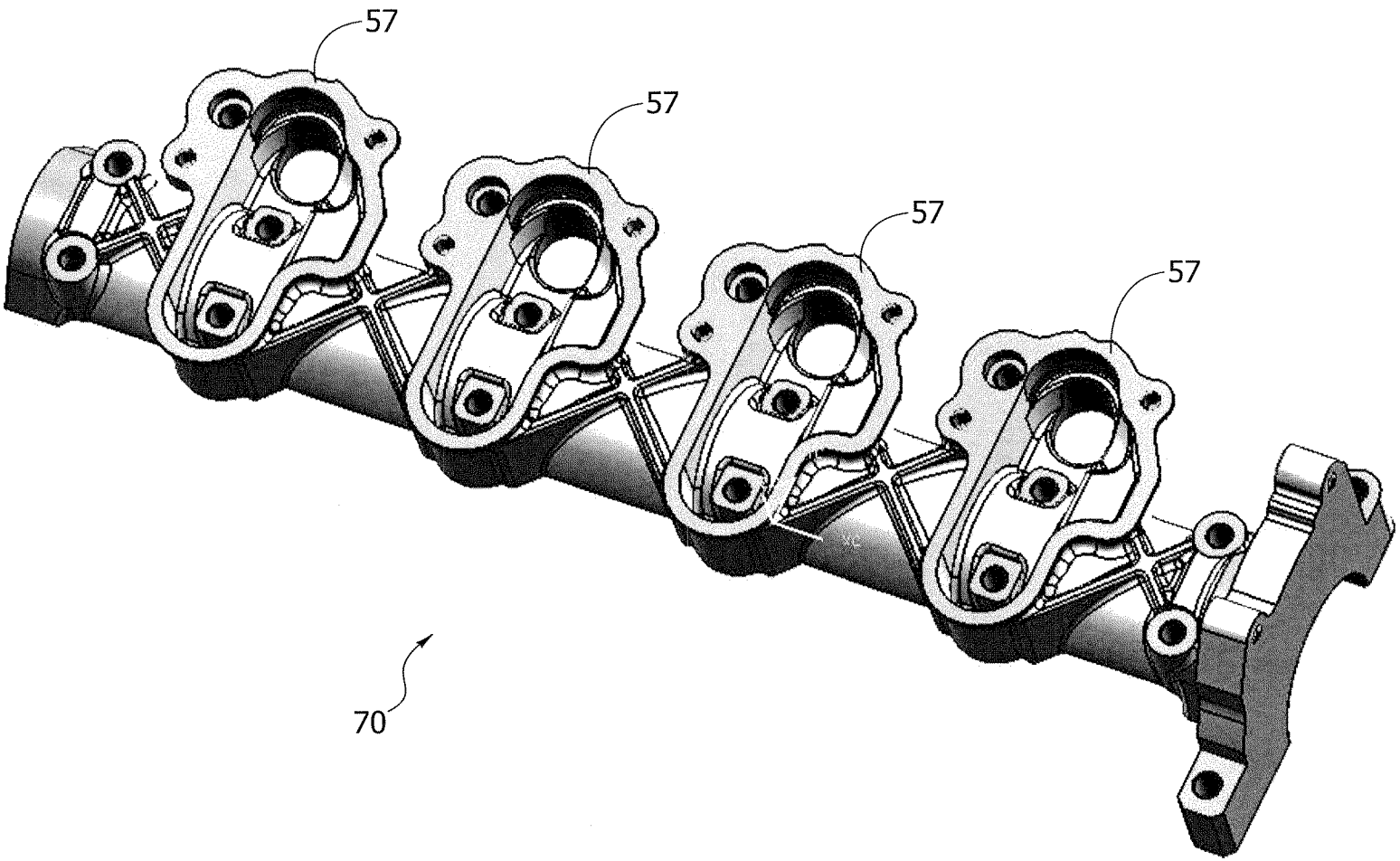
FIG. 10 is an enlarged scale perspective view of a component of the unit of FIG. 9.
Figure 11:
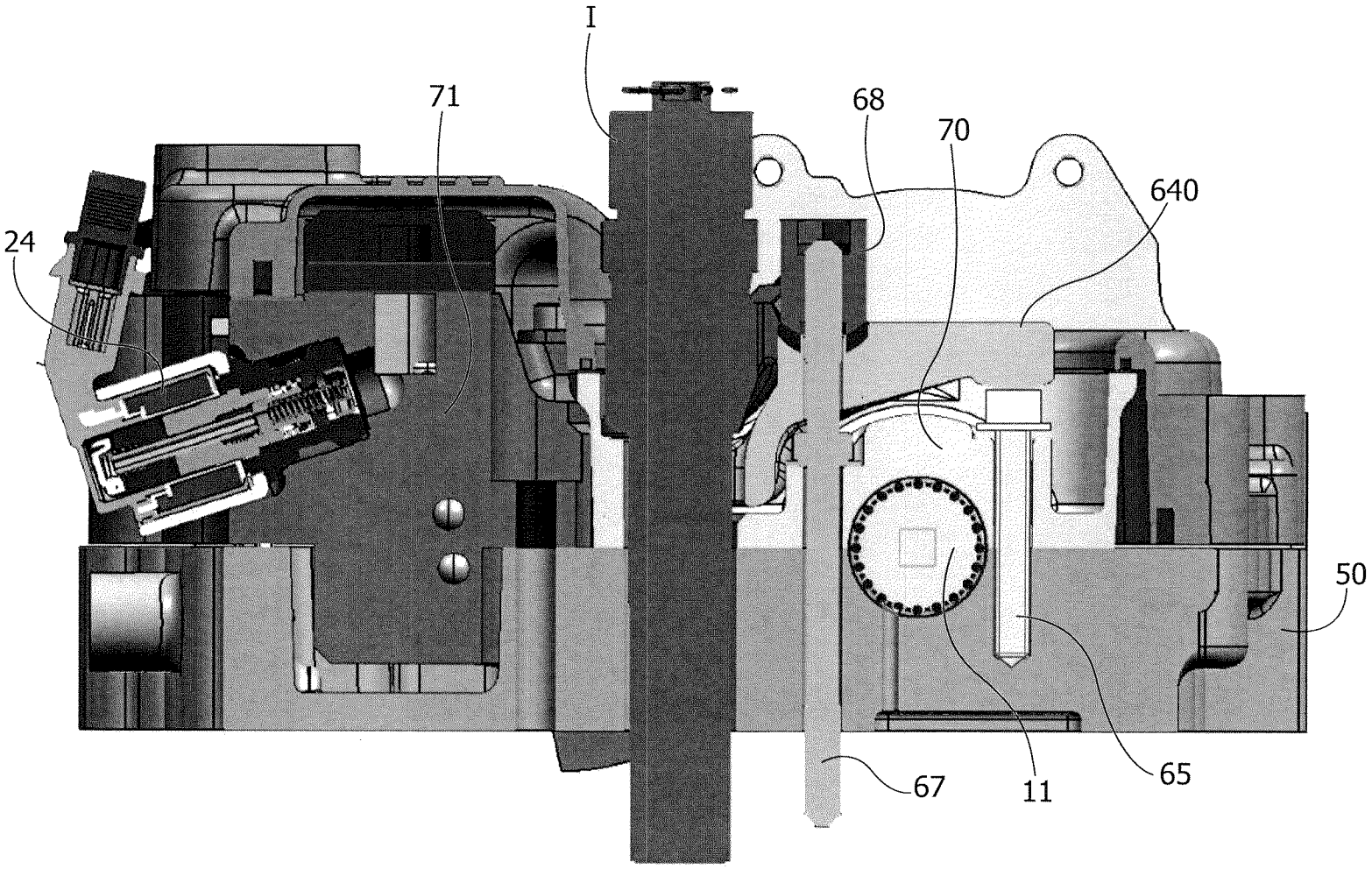
FIG. 11 is a sectional view of the unit of FIG. 9.
Figure 12:
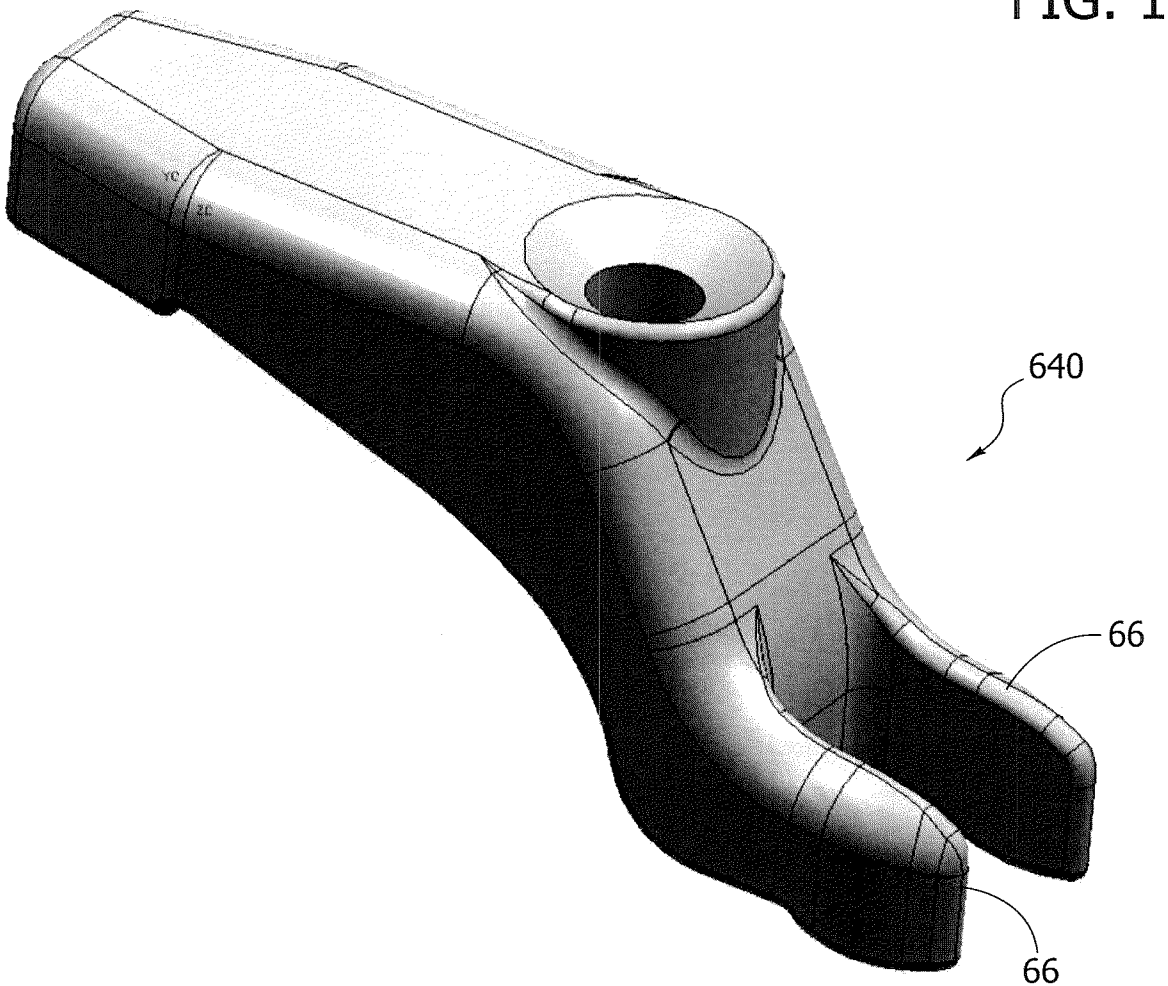
FIG. 12 is a perspective view of a bracket for locking an injector of the engine on which the unit of FIG. 9 is mounted.

Due to the abovementioned arrangement, the sealing of the fluid of the system for variable actuation of the intake valves (typically engine lubrication oil) at each of the sub-units 20A-20D is ideally guaranteed, even in the area that separates each sub-unit 20 from the one adjacent thereto (also see FIG. 8A).

Figure 7:
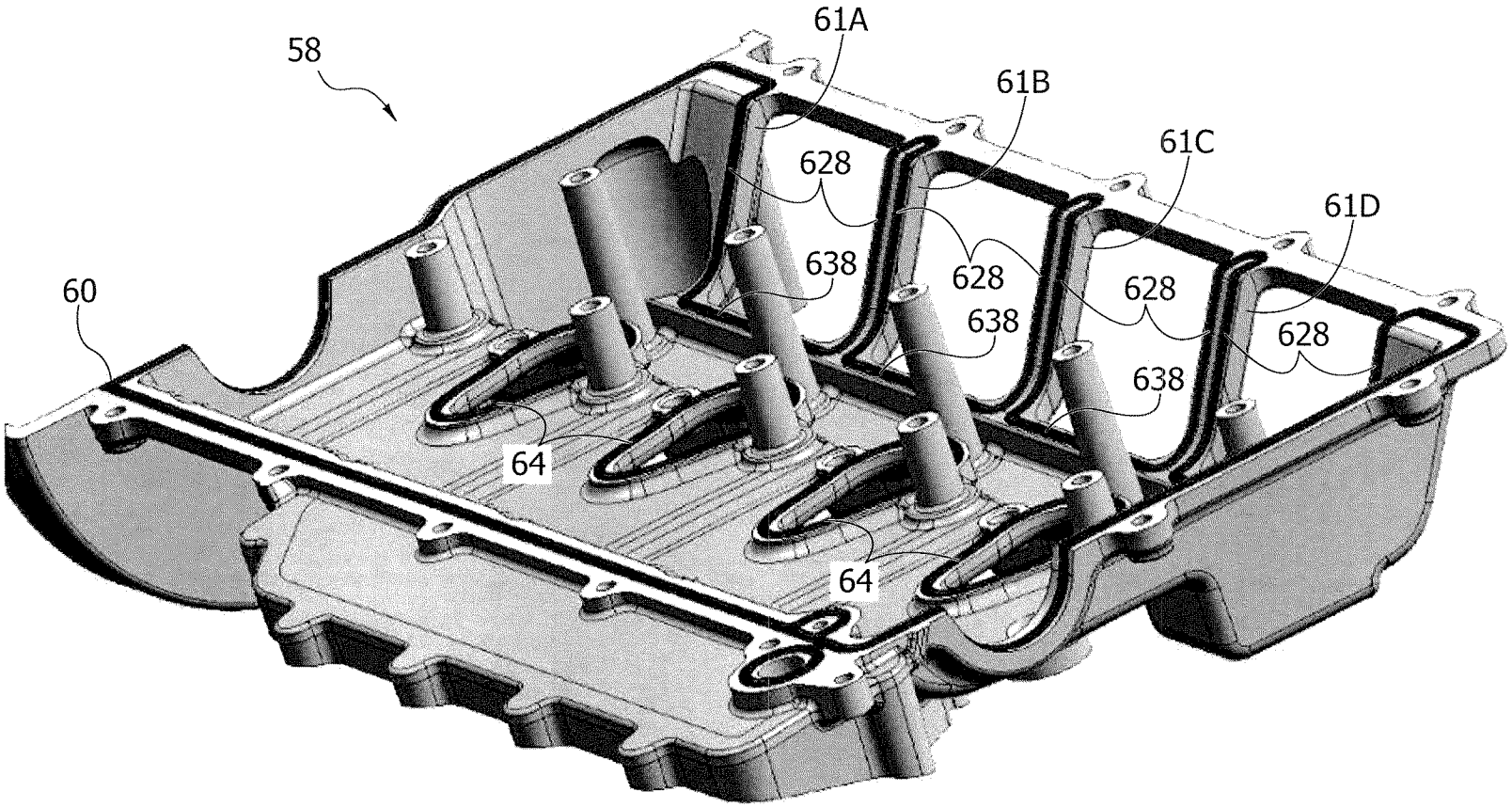
FIG. 7 is a capsized perspective view of the cover of FIG. 6.

A further problem lies in guaranteeing the sealing around each injector I. For such purpose, as previously described, each injector is surrounded by a cup-shaped casing 57, shaped extended horizontally, obtained in a single piece with the respective body 19A-D of the respective sub-unit 20A-D. The cup-shaped casing 57 defines an upper peripheral edge for the engagement of a respective sealing gasket 64 arranged within a respective groove in the lower surface of the cover 58 (FIG. 7). The plane of the upper edge of the cup-shaped casing 57 is parallel but raised with respect to the general base plane of the cover, so that the casing 57 can have the required dimension, without the risk of interference with the actuator cylinders 22 associated to the intake valves of the respective cylinder (see FIG. 3A). Actually, should the sealing gaskets 64 of the casings surrounding the injectors I be in the general base plane of the cover, there would be no sufficient room to receive them in the area comprised between the body of the injector and the body of the aforementioned actuators 22. Therefore, the arrangement described above allows guaranteeing an ideal sealing also at each injector I.

Each injector is locked in the seat thereof in the cylinder head (see FIGS. 4, 5) by means of a bracket 640 which has an end resting on a support (in the example the head of a screw 65 which is used for fixing the cover 58 on the body 50). The opposite end of the bracket 640 is fork-shaped, with two branches 66 which are engaged on two shoulders of the body of the injector. The bracket 640 is pressed in position by means of a screw 67 which engages the cylinder head. The screw 67 traverses the cover with the interposition of sealing rings and it is engaged at the upper end thereof by a nut 68 which presses—from above—the intermediate portion of the bracket 640, to lock the injector I in the seat thereof.

FIGS. 9-12 refer to a different embodiment of a unit for variable actuation of the intake valves, also in this case for a diesel engine, which is not part of the present invention, in that it does not have separate sub-units for actuating the intake valves of the different cylinders. However, also such engine has the characteristic of having cup-shaped casings 57 associated to the injectors of the various engine cylinders defining an upper sealing edge contained in a parallel plane and raised with respect to the general base plane of the cover (not shown in FIGS. 9-12). Such embodiment does not provide for separate sub-units for the system for variable actuation of the intake valves, but two single longitudinal bodies 70,71 mounted on the body 50 carrying the camshaft 11. The first longitudinal body 70 closes—at the upper part—the seat for rotatably supporting the camshaft 11 and integrates the cup-shaped casings 57 associated to the various injectors I. The second longitudinal unit 71 integrates the components of variable actuation of the intake valves of the various cylinders, with the relative solenoid valves 24. Also in this case (see FIGS. 11, 12) each injector is locked in the seat thereof by means of a bracket 65 (FIG. 12) with fork-shaped end, whose branches 66 engage corresponding shoulders provided for in the body of the injector I. Also in this case each bracket 640 has an end resting on the head of a screw 65 and it is pressed in position by a nut 68 engaged on the upper end of a screw 67 which is fastened in the cylinder head and passes through the body 50, the body 70 and the bracket 640.

Obviously, without prejudice to the principle of the invention, the construction details and the embodiments may widely vary with respect to what has been described and illustrated purely by way of example, without departing from the scope of protection of the present invention.

What is claimed is:

1. Multi-cylinder internal combustion engine, comprising, for each cylinder:

at least one intake valve and at least one exhaust valve for each cylinder, each provided with respective return spring means which push the valve towards a closed position, for controlling respective intake and exhaust conduits, at least one camshaft, for actuating the intake valves of the engine cylinders by means of respective tappets, wherein each intake valve is controlled by the respective tappet, against the action of the aforementioned return spring means, by interposing hydraulic means including a pressurised fluid chamber and a hydraulic actuator associated to each intake valve and connected to said pressurised fluid chamber, said pressurised fluid chamber being adapted to be connected by means of a solenoid valve with an exhaust channel with the aim of decoupling the intake valve from the respective tappet and causing the quick closure of the valve due to the respective return spring means, said hydraulic actuator further being provided with hydraulic braking means for slowing the final phase of the travel for closing the intake valve controlled thereby when the pressure chamber is connected to the exhaust channel, electronic control means for controlling each solenoid valve so as to vary the time and/or the opening travel of the respective intake valve as a function of one or more engine operative parameters, wherein the hydraulic means for controlling the intake valves of the engine and the solenoid valves associated thereto are part of a preassembled unit mounted on the cylinder head of the engine, wherein the abovementioned pre-assembled unit is closed at the upper part by a cover having a base peripheral edge having a perimeter groove for mounting a sealing gasket, wherein said preassembled unit is formed by a plurality of separate sub-units respectively associated to the engine cylinders and having independent support bodies mounted on the cylinder head, so that each of said support bodies can be independently demounted from said cylinder head, wherein each of said sub-unit support bodies carries the hydraulic means and the solenoid valve controlling the at least one or intake valve of the respective cylinder, and wherein said sealing gasket has a main portion extending in a general plane for supporting the cover and respective portions associated to said sub-units and projecting from said general plane, in positions arranged longitudinally adjacent to each other on one side of the cylinder head and each having a three-dimensional development, with two lateral parts contained in two planes substantially parallel to each other and orthogonal to said general plane and a central part contained in a parallel plane and spaced from said base plane, so that sealing is ensured also in the area that separates each sub-unit from the one adjacent thereto.

2. Engine according to claim 1, wherein the engine comprises a fuel injector for each cylinder, wherein the fuel injector associated to each engine cylinder is surrounded by a sealing casing which is part of a support body of the variable actuation means of the intake valves of the respective cylinder and which defines a sealing peripheral edge cooperating with said sealing cover, and wherein said sealing peripheral edge of each sealing casing is arranged in a parallel plane and raised with respect to the general base plane of said cover.

3. Engine according to claim 2, wherein each injector is locked on the cylinder head by means of a bracket which has an end resting on a support fixed to the cylinder head and the opposite fork-shaped end, with two branches which are engaged on two shoulders of the body of the injector, the intermediate portion of said bracket being pressed in position by means of a screw which engages the cylinder head.

4. Engine according to claim 1, wherein said support bodies are formed with ducts for the hydraulic connections of the system for variable actuation of the intake valves.

5. Engine according to claim 4, wherein each support body has a seat for the respective solenoid valve, the solenoid valve simply resting within said seat and being locked by a locking plate fixed by means of screws to the respective support body.

* * * * *